US011236959B2

(12) United States Patent
Dugger

(10) Patent No.: US 11,236,959 B2
(45) Date of Patent: Feb. 1, 2022

(54) DETACHABLE FIREARM MAGAZINE SPRINGS FORMED FROM WIRE HAVING NON-ROUND CROSS SECTION

(71) Applicant: Alan K. Dugger, Leander, TX (US)

(72) Inventor: Alan K. Dugger, Leander, TX (US)

( * ) Notice: Subject to any disclaimer, the term of this patent is extended or adjusted under 35 U.S.C. 154(b) by 0 days.

(21) Appl. No.: 14/108,374

(22) Filed: Dec. 17, 2013

(65) Prior Publication Data

US 2014/0196340 A1 Jul. 17, 2014

Related U.S. Application Data

(60) Provisional application No. 61/751,732, filed on Jan. 11, 2013.

(51) Int. Cl.
*F41A 9/65* (2006.01)

(52) U.S. Cl.
CPC ..... *F41A 9/65* (2013.01)

(58) Field of Classification Search
CPC ..... F41A 9/64–65; F41A 9/71
USPC ..... 42/49.01, 49.02, 50
See application file for complete search history.

(56) References Cited

U.S. PATENT DOCUMENTS 313,851 A * 3/1885 Cook ..... F41A 9/65 42/50
984,519 A 2/1911 Browning
2,081,235 A * 5/1937 Hillyard ..... F41A 9/65 42/18
2,700,540 A * 1/1955 De Juhasz ..... F16F 1/042 267/180
4,139,959 A * 2/1979 Howard ..... F41A 9/70 42/50
4,397,453 A * 8/1983 Seecamp ..... F41A 9/70 267/166.1
4,587,756 A * 5/1986 Jakubaschk ..... F41A 9/62 42/1.02
4,720,931 A * 1/1988 Jensen ..... F41A 9/83 42/87
5,228,887 A * 7/1993 Mayer ..... F41A 3/30 42/75.02
5,386,657 A * 2/1995 Racheli ..... F41A 9/69 42/50
6,032,395 A * 3/2000 Bentley ..... F41A 9/41 42/19
6,314,859 B1 * 11/2001 Weichert ..... F41A 3/86 42/1.06
6,655,066 B2 * 12/2003 Fluhr ..... F41A 17/36 42/70.02

(Continued)

OTHER PUBLICATIONS

LeoAtrox, Benelli USA Forums: Flat Wire Spring for 12-guage magazine screws, Feb. 14, 2011, vBulletin Solutions, Inc., p. 1.*

*Primary Examiner* — Troy Chambers
*Assistant Examiner* — Benjamin S Gomberg
(74) *Attorney, Agent, or Firm* — Kunzler Bean & Adamson

(57) ABSTRACT

Springs formed from non-round wire stock for a detachable magazine for a firearm are disclosed. A detachable magazine may have a body having a base, an ammunition follower positioned within the body, and a spring formed from wire having a non-round cross-section positioned between the body and the follower. The non-round wire provides a shorter compression height for the spring when compared to traditional round wire springs currently used in detachable firearm magazines.

6 Claims, 5 Drawing Sheets

(56) References Cited

U.S. PATENT DOCUMENTS

| | | | | |
|---|---|---|---|---|
| 7,353,630 | B2 * | 4/2008 | McGarry | F41A 3/86<br>42/16 |
| 7,533,483 | B1 * | 5/2009 | Alzamora | F41A 9/65<br>42/50 |
| 9,255,749 | B2 * | 2/2016 | Faifer | F41A 9/65 |
| 2007/0131104 | A1 * | 6/2007 | Botty | F41A 3/26<br>89/193 |
| 2008/0190003 | A1 * | 8/2008 | Bolen | 42/50 |
| 2012/0066950 | A1 * | 3/2012 | Davidson | F41A 9/69<br>42/50 |
| 2013/0255125 | A1 * | 10/2013 | Bath | F41A 9/70<br>42/50 |

* cited by examiner

DETACHABLE FIREARM MAGAZINE SPRINGS FORMED FROM WIRE HAVING NON-ROUND CROSS SECTION

PRIORITY

This application claims priority to U.S. Provisional Patent Application No. 61/751,732, entitled Detachable Firearm Magazines with Compression Springs Formed From Wire Having Non-Round Cross Section, filed on Jan. 11, 2013, which is incorporated herein by reference in its entirety.

FIELD

This application relates generally to ammunition feed magazines for firearms. More particularly, this application relates to compression springs formed from wire having a non-round cross-section in detachable ammunition feed magazines for increased spring life and reliability.

BACKGROUND

Magazine springs in for use in detachable magazines for fully and semi-automatic rifles and pistols are currently wound from round wire stock. For example, a typical magazine for a model 1911 pistol (U.S. Pat. No. 984,519) is shown in FIGS. 1 and 2. The prior art magazine 10 has a round wire magazine spring 20 within body 11. The magazine follower 14 keeps the magazine spring 20 from exiting the top 13 of the magazine 10, where cartridges are introduces and fed into the firearm. The base 12 is removable, allowing the spring 20 to be replaced. Generally, a magazine spring is designed to apply the proper amount of force (load) to the magazine follower to present cartridges at the proper height, angle, and timing to facilitate the reliable charging of multiple rounds. The amount of force required to provide and properly maintain reliable feeding is based on the wire size and number of coils in the magazine. The goal of loading as many rounds as possible into a magazine often becomes problematic because of the limitations imposed by the height of the compressed spring within the body of the magazine.

The quest to achieve this goal frequently results in the over compression of the spring, with the resultant induced stresses shortening the life of the spring, thus necessitating replacement. It is common practice for contemporary military operators to load their magazines to a level less than the design capacity of the magazine to preserve the duty cycle of the spring for enhanced reliability. Once over stressed, the springs lose their ability to apply sufficient force to the magazine follower, resulting in feeding malfunctions. Detachable magazine springs wound from either single wire round strand or multiple strand round wire stock material all suffer from the same dimensional limitations imposed by the stacked height of the coils in the magazine, thus yielding reduced magazine capacity and/or limited duty cycle of the spring.

SUMMARY

Springs formed from non-round wire stock for a detachable magazine for a firearm are disclosed. A detachable magazine may have a body having a base, an ammunition follower positioned within the body, and a spring formed from wire having a non-round cross-section positioned between the body and the follower. The non-round wire provides a shorter compression height for the spring when compared to traditional round wire springs currently used in detachable firearm magazines. In some embodiments, the detachable magazine may be designed to hold pistol cartridges or rifle cartridges.

In some embodiments, the non-round cross-section may be generally rectangular such that the wire has a height and a width. The spring may maintain the width generally perpendicular to the axis of compression of the spring, and the ratio between the width a and the height b is between about 1 and about 10, and in some embodiments between about 2 and 3. The spring may have any suitable shape for an ammunition magazine, such as a rounded rectangle coil shape, a round coil shape, or an elliptical coil shape, or any other suitable shape. The spring may also have any number of coils and length depending on the detachable magazine the spring is intended to be used with. Similarly, a second spring formed from wire having a non-round cross-section may be positioned within the body between the base and the follower.

These and other aspects of the present invention will become more fully apparent from the following description and appended drawings.

BRIEF DESCRIPTION OF THE DRAWINGS

The following description can be better understood in light of Figures, in which.

Figure 1:
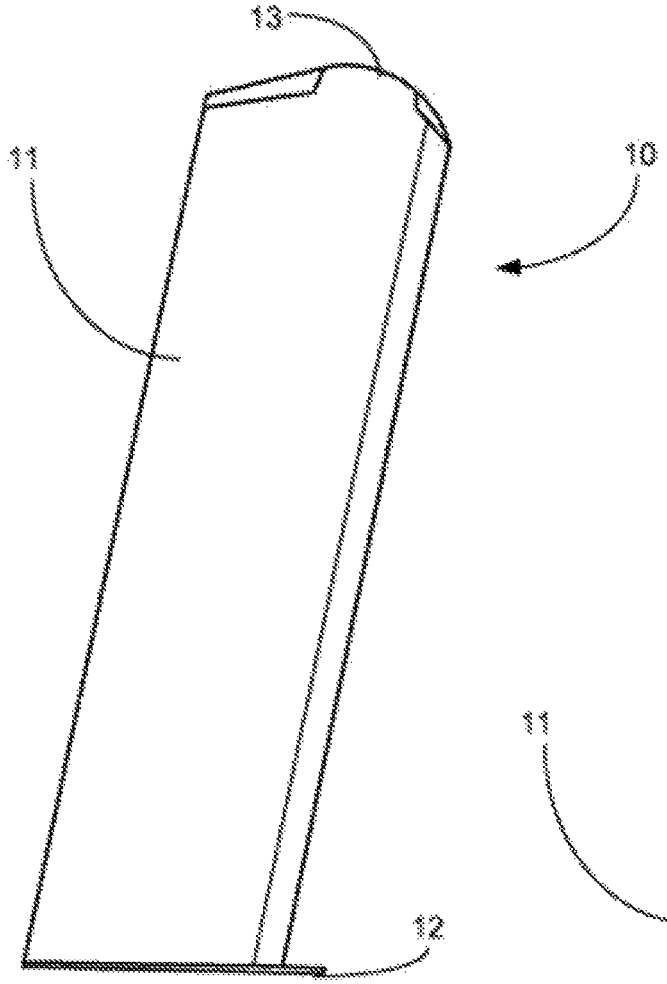
Fig. 1 (Prior Art)
FIGS. 1-2 are views of a prior art ammunition magazine with a round wire spring.
Figure 2:
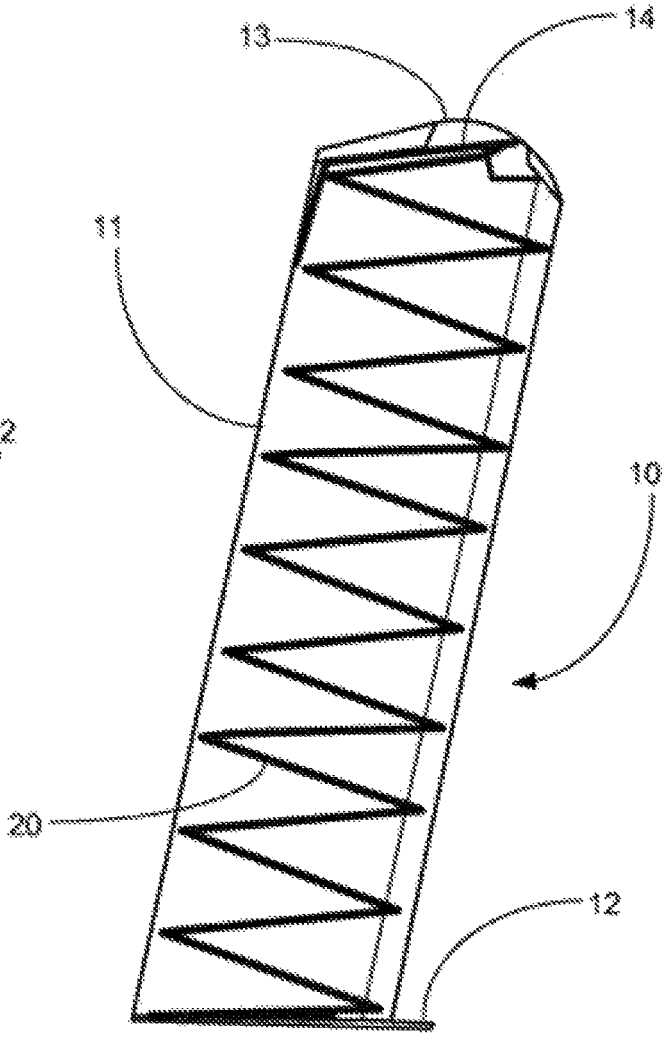
Fig. 2 (Prior Art)
Figure 3:
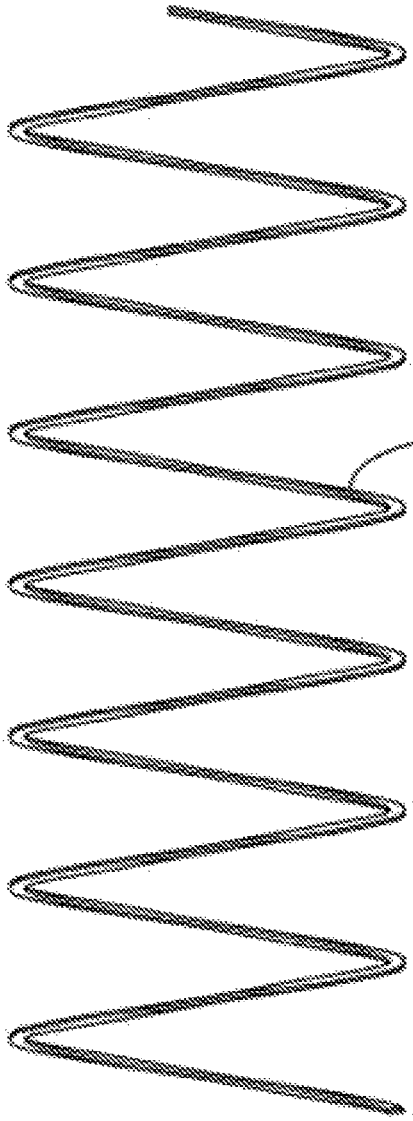
FIGS. 3-6 are various views of an exemplary ammunition magazine spring having a non-round wire cross section and a generally rounded rectangle coil shape.

Together with the following description, the Figures demonstrate and explain the principles of exemplary detachable ammunition magazine springs and associated methods of making and using them. In the Figures, the size and relative placement of components and regions of illustrated devices may be exaggerated or modified for clarity. The same reference numerals in different drawings represent the same element, and thus their descriptions may not be repeated. Some drawings may omit certain components not necessary for describing the illustrated embodiments, but which would be known to those of ordinary skill in the art to be present in and with detachable magazines for feeding ammunition in firearms.

DETAILED DESCRIPTION

As in the illustrated embodiments, aspects and features of detachable magazines for firearms with compression springs formed from wire having a non-round cross-section and associated methods of making and using them are disclosed and described below. The following description supplies specific details in order to provide a thorough understanding. Nevertheless, the skilled artisan would understand that the apparatus and associated methods of using the apparatus can be implemented and used without employing these specific details. Indeed, the devices and associated methods can be placed into practice by modifying the illustrated devices and associated methods and can be used in conjunction with any other apparatus and techniques conventionally used in the industry. For example, while this description focuses on magazines having a single spring, embodiments employing the principles described herein may be used on or with any variety of weapons and detachable magazine designs for those weapons.

Conventionally, round sectional wire is shaped to form a spring shape for use in firearms magazines. The coils of the springs may be shaped to suit the cross sectional needs (to fit within a rectangular shape thickness and width) necessary for proper use in various shapes and sizes of ammunition magazines. Shaping may be achieved by multiple means known to the industry to achieve the results. However, traditionally, this is only done for round stock wire, as shaping a non-rounded wire is very difficult.

Some advantages of using non-round wire are demonstrated in the following example. When using a semi-rectangular profile of wire (such as is as shown in FIGS. 3-12) instead of a round wire spring, the resulting semi-rectangular spring having the same strength may up to 50% of the thickness when compressed of a round wire spring of the same number of coils. As such, the semi-rectangular wire spring may also have the ability to be compressed to the full capacity of the magazine with greatly reduced and sometimes eliminated stress characteristics that generally limit the long term durability and performance of traditional round wire springs.

Additionally, in some embodiments, fewer coils may be required with non-round wire geometry. For example, a non-round wire having about the same thickness as a traditional round wire may only require seven instead of ten coils to provide the force necessary to properly feed ammunition to a firearm from a magazine. With only seven coils instead of ten, the compressed height of the coil will be less than the compressed height of the traditional coil, thereby allowing for less compression, and thereby less materials stress, and possibly increased ammunition capacity. Of course, various magazine spring designs include springs having a wide number of coils using traditional round wire. In each instance, a non-round wire, as taught herein, may provide the advantages of a smaller compressed spring height while providing the same spring strength as a traditional round wire coil spring using in ammunition magazines.

As shown in FIGS. 2-6, (and generally applicable to FIGS. 7-14) magazine springs 100 may have semi-rectangular shaped wire 110, which may include a slight radius 111 (e.g., FIG. 4) on the outer perimeters of the wider a dimension and the thinner b dimension to lessen point stresses on the outer corners of the wire. With this non-round profile, the same or greater amount of stored energy may be retained in the rectangular (flattened) shaped wire 110. Additionally the height of each coil may be up to about 50% less than a similar strength round wire coil (represented by b), which also translates to a much less overall height of the spring 100 when fully compressed as compared to a comparable strength round wire spring, which may result in significant reduction or elimination of stresses in the spring material when deflected (compressed). This reduction of stress may provide a much longer service life for the magazine spring 100 over traditional magazine springs. In some embodiments, the ration of the dimensions a/b may be between about 1 to about 10, the ratio being approximately 2 in FIG. 8 and approximately 2.7 in FIG. 4.

In operation, spring 100 when under deflection may also exhibit a highly reduced propensity to buckle from side to side while being compressed. Round wire magazine springs naturally buckle under deflection, which causes increased friction between the mating surfaces of the spring and magazine body. Additionally, as coils of a spring touch, the spring loses a portion of its strength. The friction between the mating surfaces and loss of strength also results in a distinct hesitation caused by the buckling axis shift of the round wire spring which inhibits the consistent presentation of the cartridges at the proper angle for reliable feeding from the magazine.

In some embodiments, a larger dimension of the semi rectangular wire 110 when wound/formed on the a dimension may also provide superior support to the base of any magazine follower used, which may greatly reduce commonly encountered malfunctions caused from "follower tilt" of the magazine follower (improper feeding angle presentation) for the reliable feeding of the remaining cartridges in the magazine.

In order to form a non-round wire stock into a magazine spring 100 as shown in the figures, complex holding and forming computer-aided machine technology is required. This technology is relatively new, but will be known to one of ordinary skill of machining springs. The application of this technology to spring manufacturing equipment is new, expensive, and has not been utilized before to create springs as shown in FIGS. 2-14, particularly for detachable magazines for firearms, where the longer a dimension is generally maintained in a perpendicular to the compression axis of the magazine spring 100, 200, 300.

Figure 5:
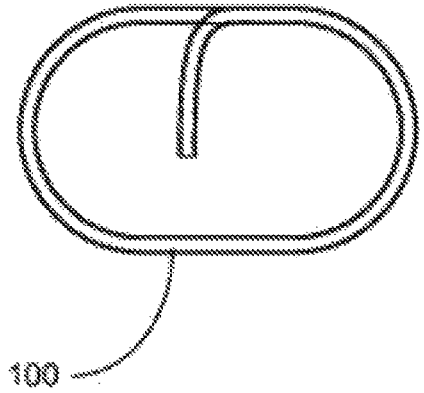
Figure 6:
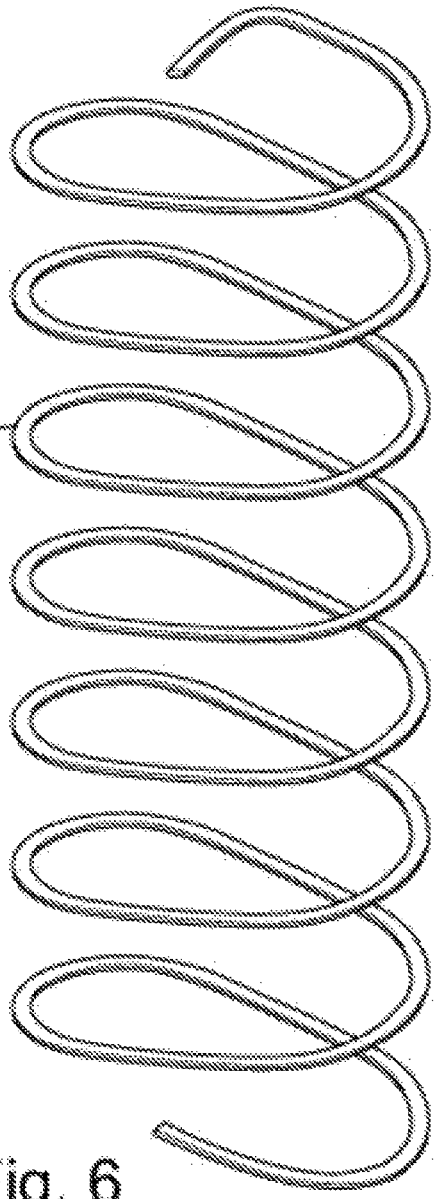
Figure 4:
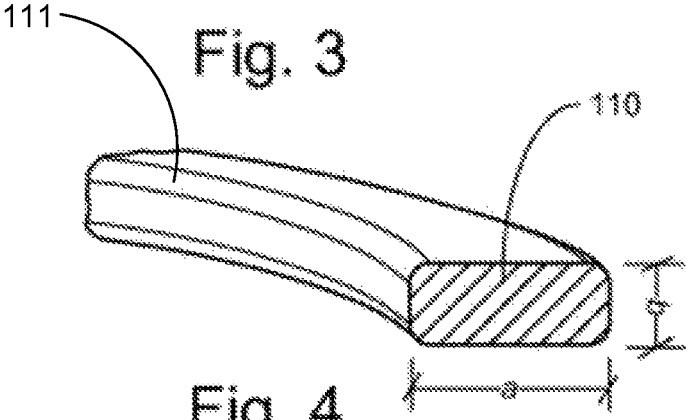
Figure 7:
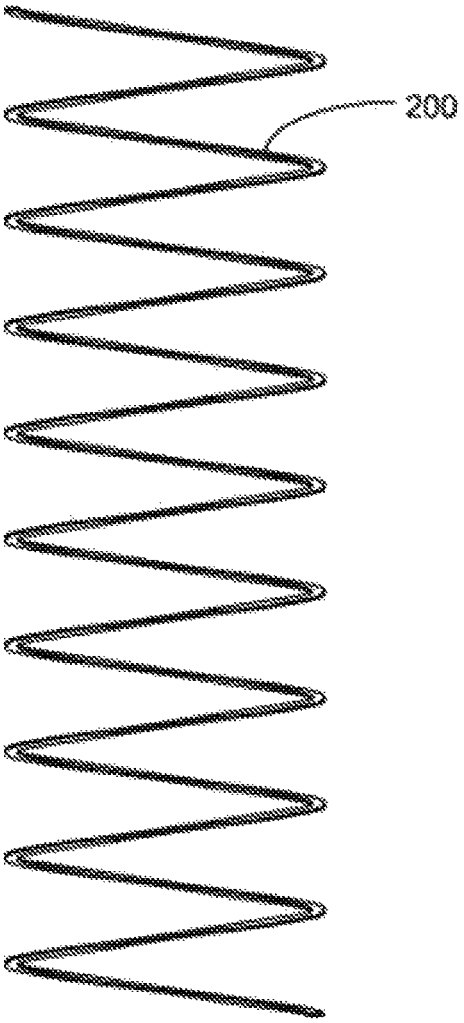
FIGS. 7-10 are various views of an exemplary ammunition magazine spring having a non-round wire cross section and a round coil shape.

As shown in the Figures, magazine springs according to various embodiments, may be formed in any shape used with detachable firearm magazines. For example, FIGS. 2-6 show a generally rounded rectangle coil shape 100, as best shown in FIG. 5, with a semi-rectangular wire shape 110, as best shown in FIG. 4. Such a design may be used with the model 1911 magazine 10 of FIG. 1, or other similar magazines.

Figure 8:
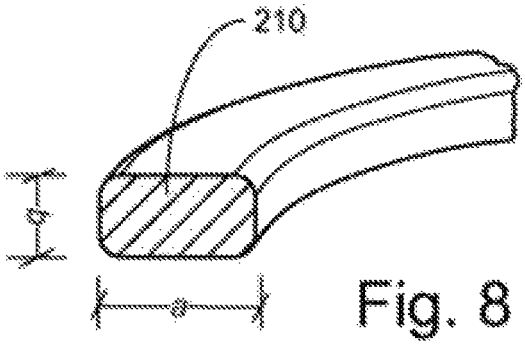
Figure 9:
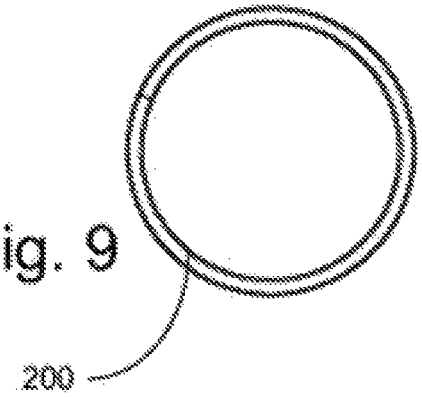
Figure 10:
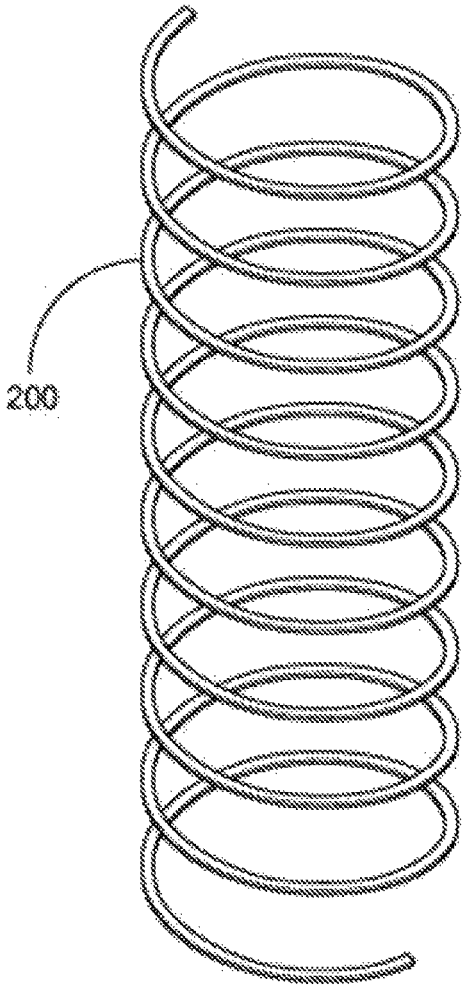
Figure 11:
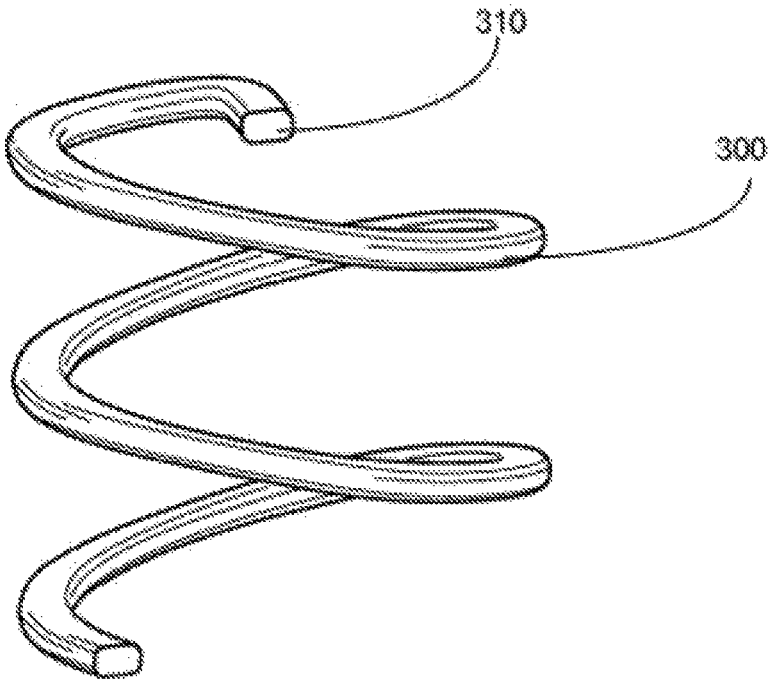
FIGS. 11-14 are various views of an exemplary ammunition magazine spring having a non-round wire cross section and a generally oval coil shape.
Figure 12:
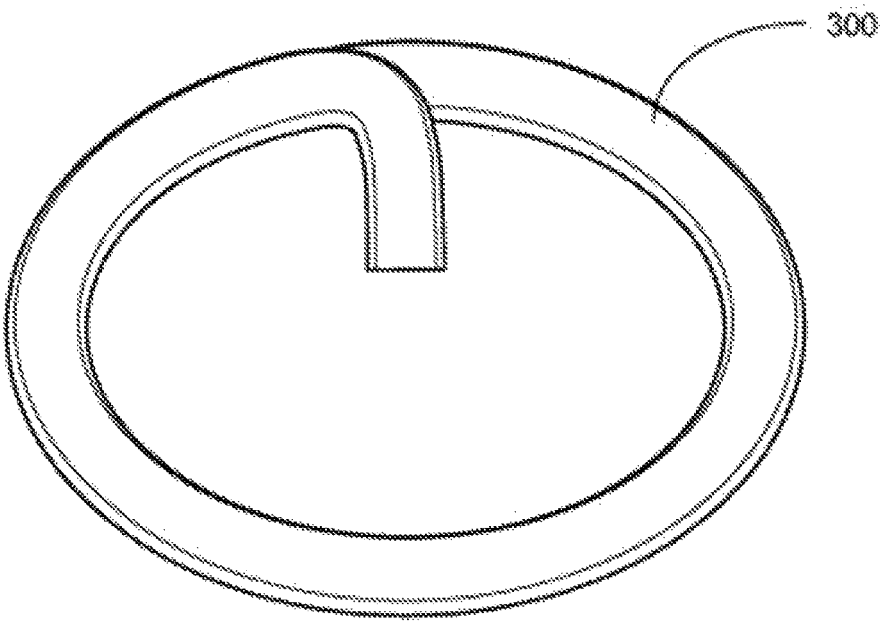
Figure 13:
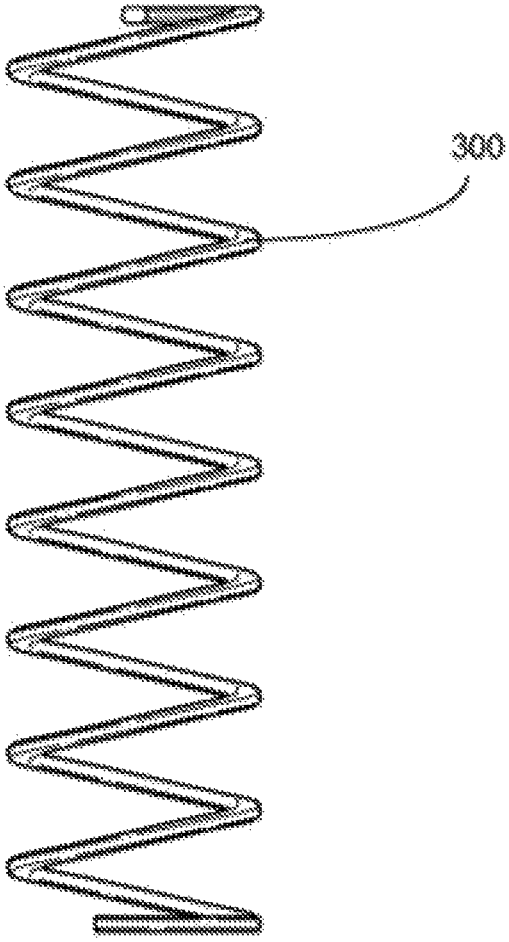
Figure 14:
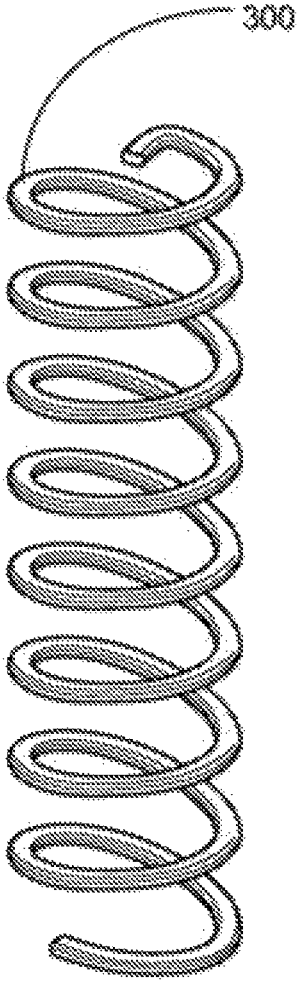

In other embodiments, some detachable ammunition magazines may use one or more round coil shaped springs 200, such as those shown in FIGS. 7-10, or generally elliptical shaped coil springs 300, as shown in FIGS. 11-14. In particular, the wire shape 210 of both round coil shape 200 and generally elliptical coil shape 300 (or any other coil shape) may be non-round such as is shown in FIG. 8. In any configuration, the non round wire may provide the same or similar advantages as those discussed above over traditional round wire springs.

In some embodiments, non-round springs may be used in other firearms applications where repeated full spring compression may be a problem. Additionally, the non-round springs may have any number of coils or be of any length, depending on the conventional spring the non-round spring will replace. In other embodiments, particularly with regards to high-capacity magazines, the use of the non-round spring may allow for additional ammunition capacity in the same sized magazine as a traditional wire spring would allow, or for which the magazine was originally designed. Additionally, the use of non-round springs may also provide additional advantageous design parameters for new magazine designs to allow more ammunition in a more compact magazine design. Furthermore, the non-round springs may also allow for a shorter compressed spring height, whether by fewer coils or by shorter cross-sectional height of each coil.

While the cross-sections shown tend to have rounded edges, in some embodiments, the non-round wire used to manufacture magazine springs may be a generally square, rectangular, flat, ovoid, or other non-round shape, where the larger cross-sectional dimension is generally perpendicular to the axis of compression of the spring.

In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. Also, as used herein, examples are meant to be illustrative only and should not be construed to be limiting in any manner.

What is claimed is:

1. A detachable magazine for a firearm, comprising a body having a base;

an ammunition follower positioned within the body; and a compression spring disposed within the body between the base and the follower and formed from a wire, the compression spring having a plurality of coils, each of the plurality of coils having a non-round coil shape and a uniform size, where the wire has a non-round cross-section and comprises a pair of substantially parallel side surfaces having a height, and a top surface and a bottom surface that are substantially parallel and have a width, where a transition between either of the pair of substantially parallel side surfaces and either of the top surface or the bottom surface comprises a surface defined by a radius, where the width is greater than the height and a ratio between the width and the height is about 2.7, and where the width is oriented generally perpendicular to an axis of compression of the compression spring.

2. The detachable magazine for a firearm of claim 1, where the detachable magazine is configured to hold pistol cartridges.

3. The detachable magazine for a firearm of claim 1, where the detachable magazine is configured to hold rifle cartridges.

4. The detachable magazine for a firearm of claim 1, where the compression spring has a rounded rectangle coil shape.

5. The detachable magazine for a firearm of claim 1, where the compression spring has an oval coil shape.

6. The detachable magazine for a firearm of claim 1, where the compression spring has an elliptical coil shape.

* * * * *